United States Patent [19]

Nakayama

[11] Patent Number: 4,558,851

[45] Date of Patent: Dec. 17, 1985

[54] FENCE OF WIRE LATTICEWORK

[75] Inventor: Kiyoshi Nakayama, Takamatsu, Japan

[73] Assignee: Asahi Wire Nets & Steel Ltd., Kagawa, Japan

[21] Appl. No.: 389,363

[22] Filed: Jun. 16, 1982

[51] Int. Cl.[4] ..... E04H 17/16

[52] U.S. Cl. ..... 256/24; 256/73; 256/23

[58] Field of Search ..... 256/33, 32, 47, 24, 256/23, 73

[56] References Cited

U.S. PATENT DOCUMENTS 2,996,285 8/1961 Johnson ..... 256/47

3,089,681 5/1963 Smithwick ..... 256/47

FOREIGN PATENT DOCUMENTS 1032475 6/1966 United Kingdom ..... 256/33

*Primary Examiner*—Andrew V. Kundrat

[57] ABSTRACT

Fence of wire latticework comprises lattice bodies composed of vertical wire members, and horizontal wire members, supports for supporting the lattice bodies, and connecting means for connecting the lattice bodies and the supports. Furring strips are not employed herein. The lattice body is formed, at its upper and/or lower ends, with cylindrical parts which are provided by forming the end portions in circle and the horizontal wire members.

24 Claims, 22 Drawing Figures

FENCE OF WIRE LATTICEWORK

BACKGROUND OF THE INVENTION

Field of the Invention

The invention relates to a fence of wire latticework, in which a plurality of wire members are combined lengthwise and widthwise by weldments or the like, and are supported with supports.

A conventional fence of wire latticework is held at its right and left sides with supports, and is held at its top and bottom with furring strips which are the same as or smaller than the supports in diameter.

However, since the furring strip is heavy in weight, it causes bad influence to strength over the whole structure of the fence. In comparison with the lattice, the furring strip is subject to the wind pressure or snowfall, and also at this point, the rigidity of the fence is affected. The lattice part is perspective but the part of the fence having the furring strip obstructs the view. Further, the furring strip is expensive in manufacturing because it comprises much iron, and an assembling work of the fence is not easy because it requires the combination of the furring strips with the lattice body.

SUMMARY OF THE INVENTION

A first object of the invention is to provide a fence of wire latticework which is light, particularly at the top portion thereof and in which the strength of the fence as a whole is increased.

A second object of the invention is to provide a fence of latticework which stands up against the wind pressure or the snowfall.

A third object of the invention is to provide a fence of the latticework which does not obstruct a view and does not do aesthetic harm.

A further object of the invention is to provide a fence of latticework which is economical and easy in setting-up.

The fence of the invention is basically composed of the lattice body combined with wires running vertically and wires running horizontally, supports and connecting means for connecting the lattice body and the supports. The furring strip is not employed. The vertical wire member is processed in circle at its top or its top and bottom. At the top of the lattice, a cylindrical part is formed in parallel with the horizontal wire member. This cylindrical part is substituted for the furring strip. It is preferable that a rigid member is used for the horizontal wire member, or the numbers of pieces are increased to heighten the strength of the fence. The cylindrical part may be provided at both of the upper and lower ends of the fence or either one of them separately.

DETAILED DESCRIPTION OF THE PREFERRED EMBODIMENTS

Figure 1:
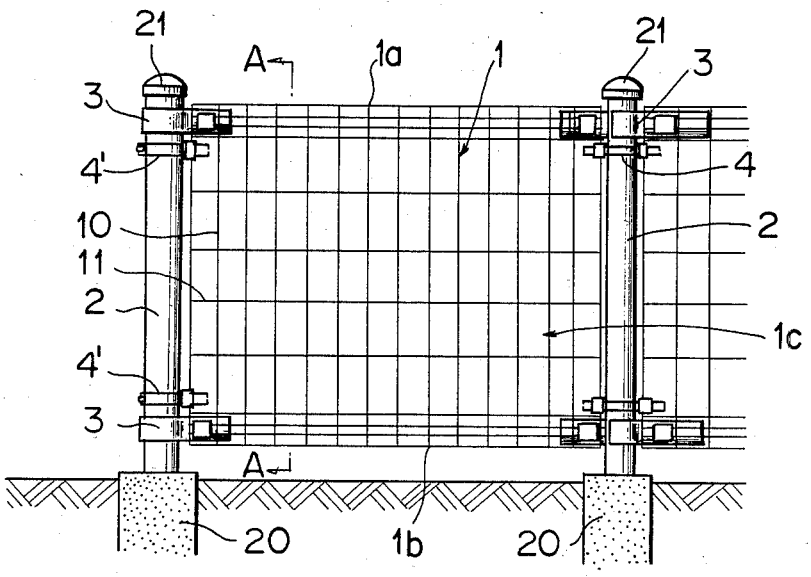
FIG. 1 is a front view showing one example of the fence of latticework according to the invention.
Figure 2:
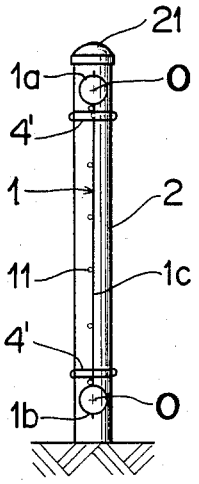
FIG. 2 is a cross sectional view seen from A—A line in FIG. 1.

In the drawings, the reference numeral 1 denotes a lattice body, 2 designates a support, and 3 and 4 denote connecting means.

Figure 3:
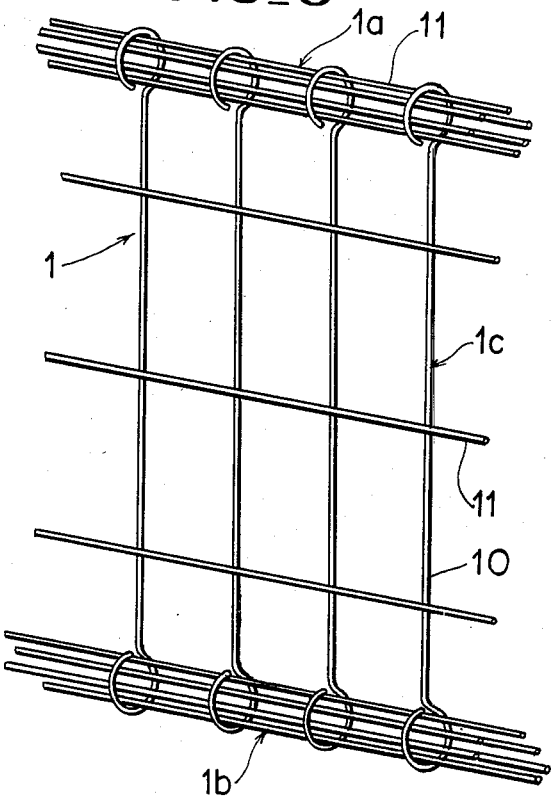
FIG. 3 is a perspective view of the lattice body.

The lattice body 1 (FIG. 1) comprises a plurality of vertical wire members 10 and a plurality of horizontal wire members 11, fixed to each other by welding. The upper end of the individual vertical member is formed in circle (as shown in FIG. 3) and consequently the top portion of the lattice body 1 is formed with a cylindrical part 1*a* formed of a plurality of wire elements. In this embodiment the bottom of the lattice body 1 is also formed with a cylindrical part 1*b* formed of a plurality of wire elements.

It is preferable that the diameters of the cylindrical parts 1*a* and 1*b* are the same as or smaller than the diameter of the support 2. The cylindrical part of the instant embodiment has the diameter smaller than the support. Preferably, the number of the horizontal wire members are so many as to make them sufficiently close one another, and in the shown example, six members 11 are arranged (FIG. 1) within the cylindrical parts 1*a*, 1*b*, so that the sufficient strength of the fence may be provided. Instead of increasing the number of wire members, the material of high strength may be used for heightening the rigidity of the fence.

The end portion of the vertical member 10 is preferably bent in circle in the direction of holding the members 11 which form the cylindrical part. It is desired that the center (0) of the cross section of each respective circle of the cylindrical part 1*a* or 1*b* be positioned on an extension of the plain part 1*c* of the lattice body. For making the lattice body 1, the vertical members 10 and the horizontal members 11 are coupled and the top ends and/or the bottom ends of members 10 are bent to form the cylindrical parts 1*a*, 1*b*.

The thus prepared lattice body 1 is secured to the support 2 by means of the connecting members 3, 4. The support 2 is made of steel pipe and positioned on a base 20. Any shape of the support 2 can be proper for supporting of lattice body 1. On the support 2 a cap 21 is mounted. The support and the cap are fixed to each other by welding. For fixing the caps to the supports conventional methods are used which may be divided into two processes. In one of them the electric current passes through the components to be fixed while the pressure is effected at the side of the cap. This process has the disadvantage that a thickness of the cap should be made thin. In the other method the welding is carried out on a boundary between the cap and the support by the arc welding or the like. In the latter case, the cap may be made sufficiently, but the welded part is exposed outside of the cap and rust can easily occur thereon. Furthermore the welding requires much work.

In view of such circumstances, the inventor has suggested a design on the connection between the cap and the support, which allows for the sufficient thickness of the cap and does not require the exposure of the welded part.

Figure 4:
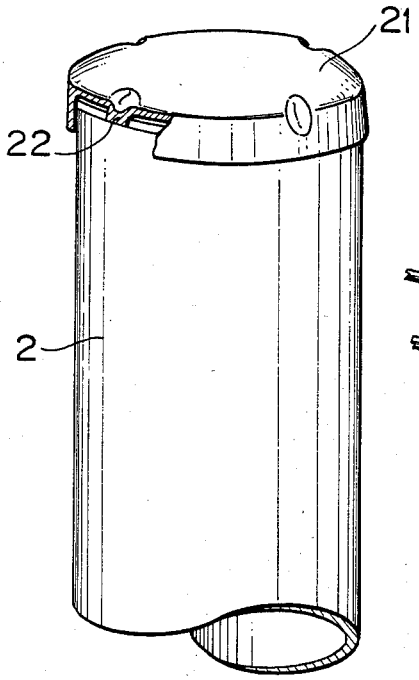
FIG. 4 is a perspective view of a part of an upper end of the support.

As seen in FIG. 4, the edge of the cap 21 is pressed on its circumference so as to make a number of concave surfaces (in the instant case at 4 positions). Convex surfaces 22 are made on the reverse side of the cap 21 accordingly. As the convex surfaces 22 come to contact the edge of the upper end of the support 2, the electric current is supplied thereto, for welding the convex surfaces 22 of the cap 21 to the upper end of the support 2. Depending upon this structure, the thickness of the cap 21 may be greater, and since the welded part is not exposed outside the cap, there is no problem of rusting, and the connection is satisfactory owing to the electric welding.

Figure 5:
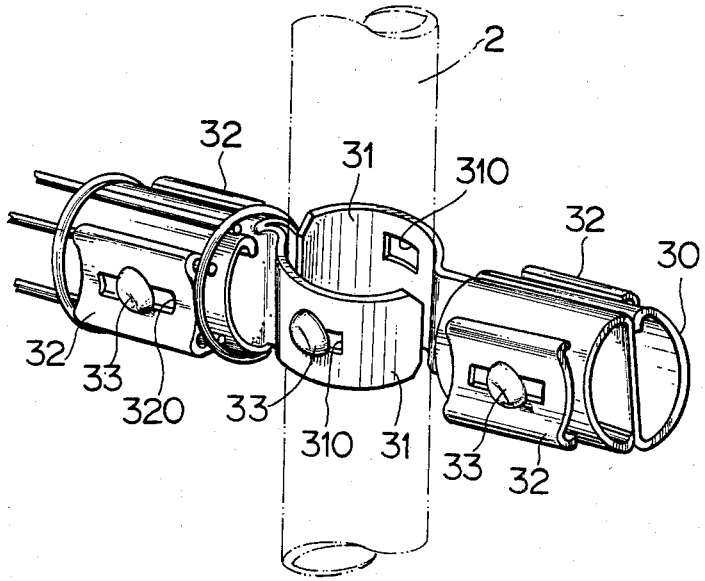
FIG. 5 is a perspective view of a connecting means for the cylindrical part.

The lattice body 1 and the support 2 are fixed at the cylindrical parts 1*a*, 1*b* by connecting means 3, and at the plain part 1*c* of the lattice body by connecting means 4. The connecting means 3 for the cylindrical part is, as seen in FIG. 5, composed of a tubular body 3*p*, a plate band 31 fixed thereto, pressing metal plats 32 and bolt-nuts 33. The tubular body 30 has a diameter smaller than that of the cylindrical parts 1*a*, 1*b*. The tubular body 30 is formed with bolt aperture 301 (FIG. 5). The pressing metal plate 32 is defined with bent portions provided at its both sides for holding the respective horizontal members 11 of the cylindrical parts 1*a*, 1*b*. Each plate 32 is formed with an oblong hole 320 at its center. The cylindrical parts 1*a*, 1*b* are held with the pressing metal plate 32 applied from the outside, and a bolt 33 is passed through the oblong holes 320 of the metal plates 32 and the bolt apertures 301, so that the tubular body 30 and the seat metal plate 32 hold the cylindrical parts 1*a*, 1*b* by nuts.

Figure 6:
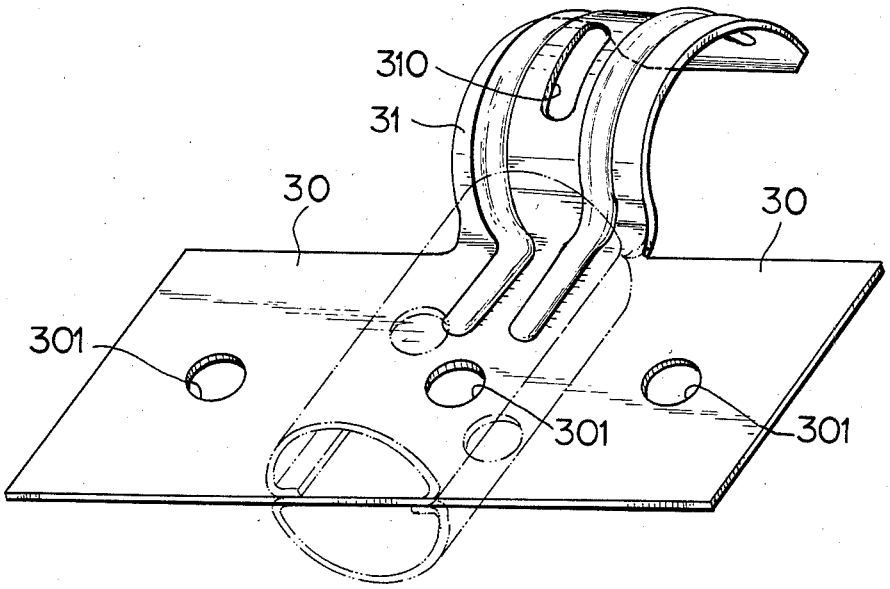
FIG. 6 is a developed view of a band-like blank for the connecting means at the cylindrical part.

The band 31 follows in shape the side face of the support 2, and as the support 2 is tubular in this example, the band is semi-circular. Two semi-circular bands 31, 31 support the support 2 as shown in FIG. 5. Each band 31 is formed with an oblong hole 310 and the support 2 is formed with respective holes at the corresponding portion for the bolt-nut 33. If the support 2 is endmost and is not attached to the connector 3 at its one side, a seat metal plate of the same shape as the band 31 is applied to the opposite side of the support 2, and is secured by the bolt-nut 33. The tubular body 30 and the band 31 may be separately made and combined by welding. In the present case, one steel sheet is treated with bending process as shown in FIG. 6. The bolt of the bolt-nut has a round head and a square root, and it is used so that the round head appears outside the plates 32 or bands 31. In such a manner the fence can not be disassembled from the outside.

Figure 7:
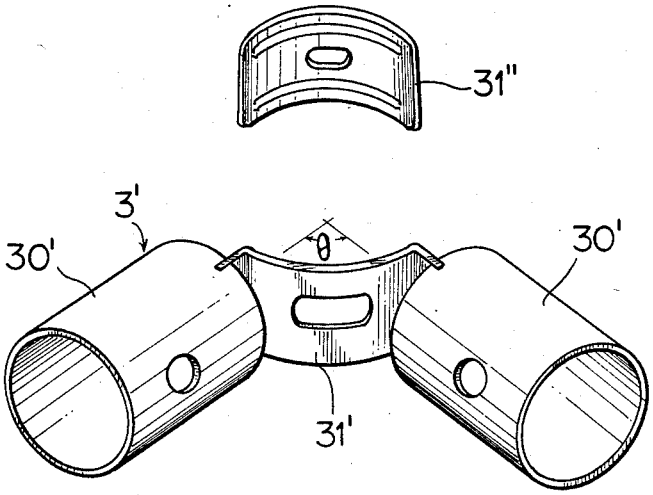
FIG. 7 is a perspective view showing the connecting means to be applied to corners at the cylindrical part.
Figure 9:
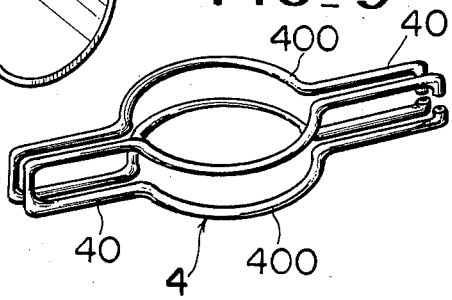
FIG. 9 is a perspective view of a wire-made band of the connecting means.
Figure 8:
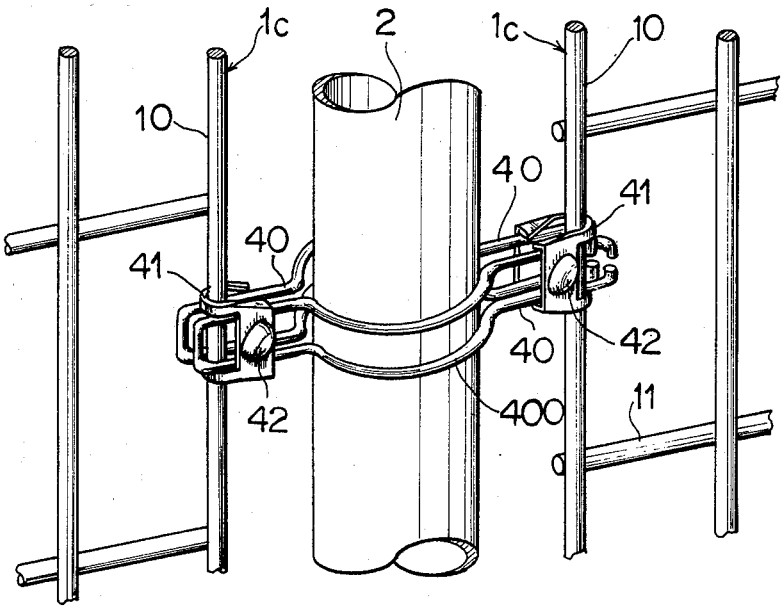
FIG. 8 is a perspective view of the connecting means in a plain part.

FIG. 7 shows a connecting member 3' for the fence bent at right angle or a predetermined angle around the support 2. In this connecting means 3', tubular bodies 30', 30' are fixed to the both sides of a band 31' at the predetermined angle (0). A seat plate 31'' of the same shape as the band 31' is provided to hold the support 2 by connecting the band 31' and the seat plate 31' to each other with the bolt-nut 33. The tubular bodies 30', 30' and the cylindrical parts 1*a*, 1*b* are connected similarly by the pressing metal plate 32 and the bolt-nut 33. Depending upon the connecting means 3', the fence may be bent around the support 2 at the angle (0) between the tubular bodies 30', 30'.

FIGS. 8 to 11 show the connector 4 to be used in the plain part 1*c* of the lattice body. The connector 4 comprises a band 40, a U-shaped seat plate 41 and a bolt-nut 42. The band 40 is formed by bending an entire wire member in rectangle and making a semi-circle following the outer surface of the support 2. The thus bent wire member holds the support 2 and the plain part 1*c* together.

Figure 10A:
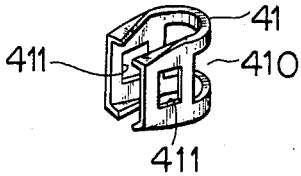
FIGS. 10A and 10B are perspective views of U-shaped seat plates of the connecting means.
Figure 10B:
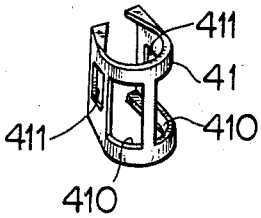

The U-shaped seat plate 41 is made out of a plate piece by bending, and is formed with a hole 410 for passing the end of the band 40, and the hole 410 may be partitioned into two portions as shown in FIG. 10(B). The plate 41 is formed with square holes 411 for passing the bolt.

With respect to the seat plate 41, the end of the band 40 passes through its hole 410 and is fixed with the bolt-nut 42. The bolt-nut 42 has preferably a round head and a square root. Due to the structure of the connector 4 the connecting work is easy and the band 40 may be easily processed from the wire material.

Figure 11:
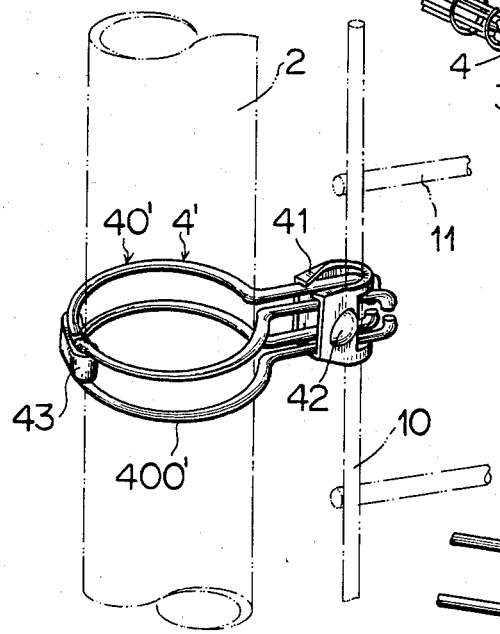
FIG. 11 is a perspective view of the connecting means in the plain part to be applied to the end of the fence.

FIG. 11 shows a connecting means 4' for the end of the fence. Since at the end of the fence the lattice body 1 is positioned at one side of the support 2, it is sufficient to form the wire material into a portion of a rectangular shape of a shorter size and a semi-circle portion 400'. A couple of bands are connected to each other by means of a connecting piece 43 mounted at the end of the semi-circle portion 400'. The connection of the connecting piece 43 and the band 40' is made moderate so that the band 40' may be opened for easy working. The U-shaped seat plate 41 and the bolt-nut 42 are of the same structure in FIG. 8.

The above mentioned fences may be more varied than the examples disclosed herebefore.

Figure 12:
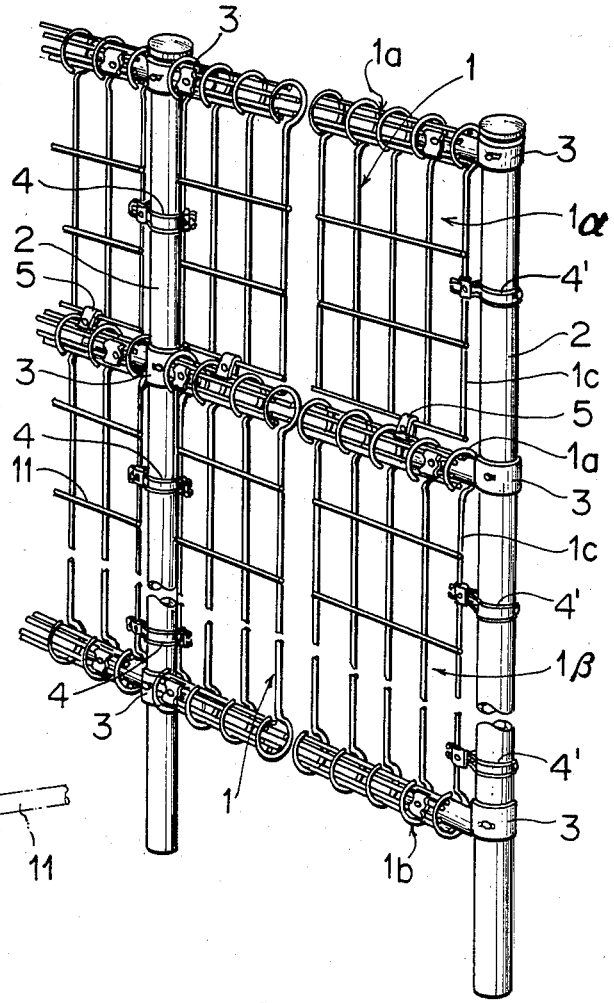
FIG. 12 is a perspective view showing another embodiment of the fence of the wire latticework of the invention.

FIG. 12 shows an example of double lattice bodies where the upper lattice 1*a* is not provided with the lower cylindrical part 1*b* and the upper fence is composed of the upper tubular body 1*a* and the plain part 1*c* only. The upper lattice body 1*a* is secured to the support 2 with the connector 3 4, 4' in the cylindrical part 1*a* and the plain part 1*c*. A lower lattice body 18 is secured to the support 2 with the connector 3, and connectors 4, 4' in the cylindrical part 1*a* and 1*b* and the plain part 1*c*.

The upper lattice body 1*a* and the lower lattice body 18 are connected to each other by coupling metal plates 5 at the lower horizontal wire member 11 of the lattice body 1*a* and the upper horizontal wire member 11 of the cylindrical part 1*a* of the lattice body 18. The coupling metal plate 5 is, as shown in FIG. 13, U-shaped with a hook at the end and formed with a square hole into which the round headed and square rooted bolt of the bolt-nut 50 is passed and screwed with the nut.

Figure 14:
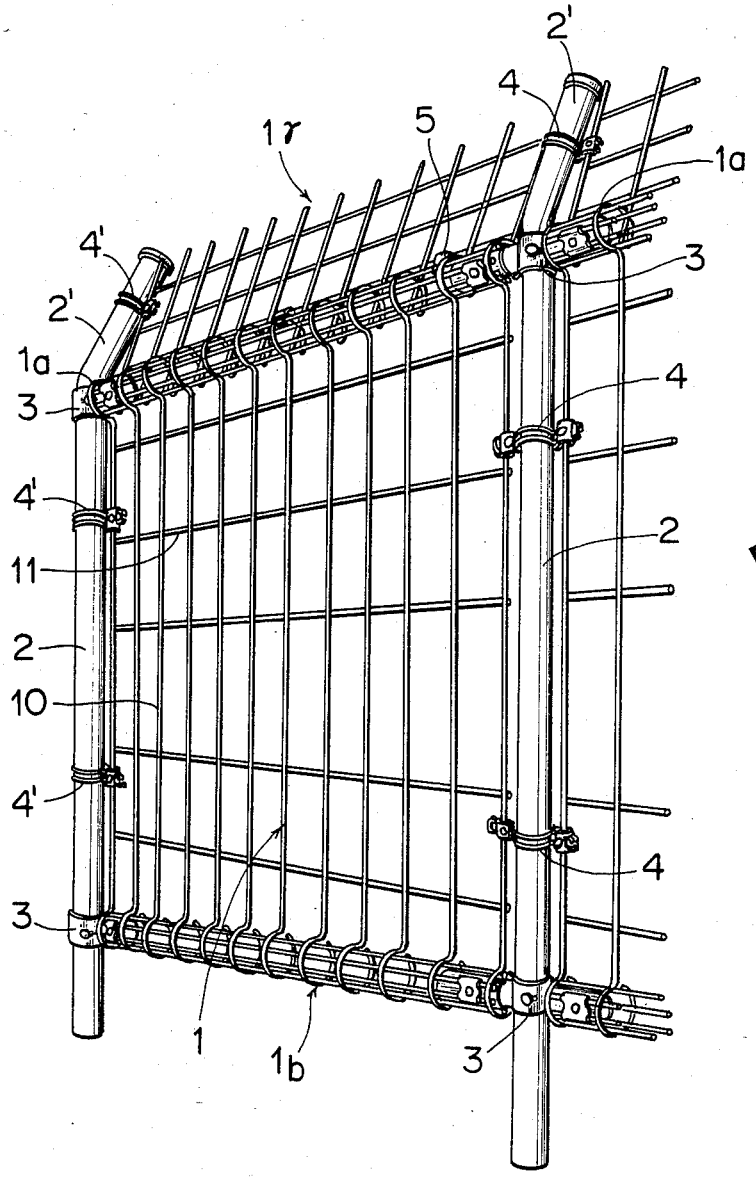
FIG. 14 is a perspective view showing an example of the fence with spikes of latticework.

FIG. 14 shows an example of providing spikes on the fence. The fence is provided with spiked lattice body 1$\gamma$ at a predetermined angle, and a support 2' is bent at the same angle as the spiked lattice body 1$\gamma$. The lattice body 1$\gamma$ is not provided with the cylindrical part and is composed of the plain part only. The lattice body 1$\gamma$ is secured to the support 2' nearly its upper portion by means of the connectors 4, 4', and the lower portion by means of the cylindrical part 1*a* of the vertical lattice body 1 and the coupling metal plates 5.

Figure 13:
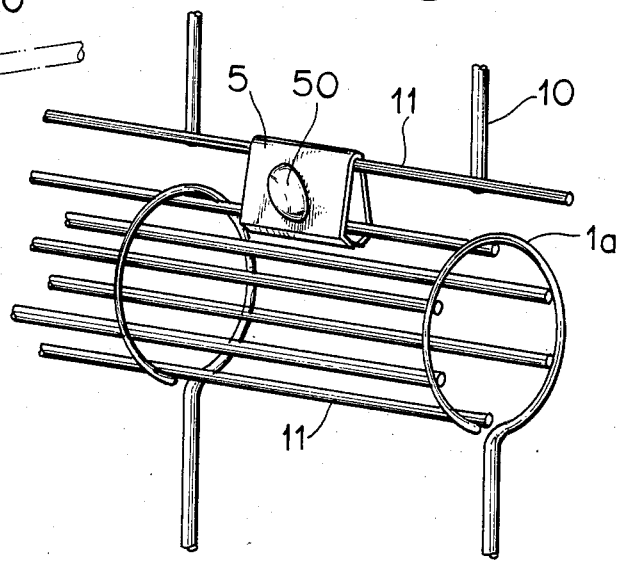
FIG. 13 is a perspective view showing a connecting structure of the upper lattice and the lower lattice.
Figure 15:
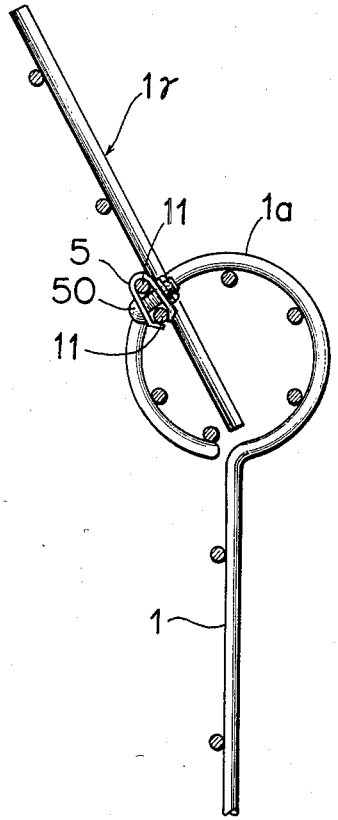
FIG. 15 is a partially enlarged view showing the connecting structure of the spiked lattice body and the vertical lattice body.

The coupling metal plate is the same as shown in FIGS. 12 and 13 and the production cost may be reduced since it has common parts. This coupling metal plate 5 and the bolt-nut 50 hold, as shown in FIG. 15, the horizontal wire member 11 of the spiked lattice body 1$\gamma$ and the horizontal wire member 11 of the cylindrical part 1*a* of the vertical lattice body 1.

Figure 16:
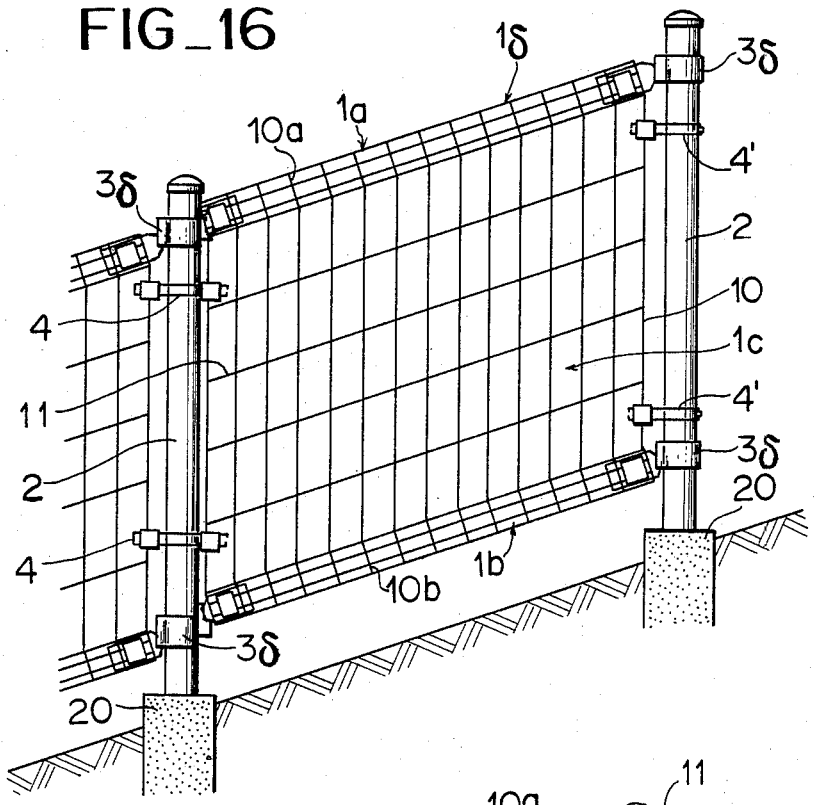
FIG. 16 is a front view showing an example of the fence of the latticework placed on the slope ground.
Figure 17:
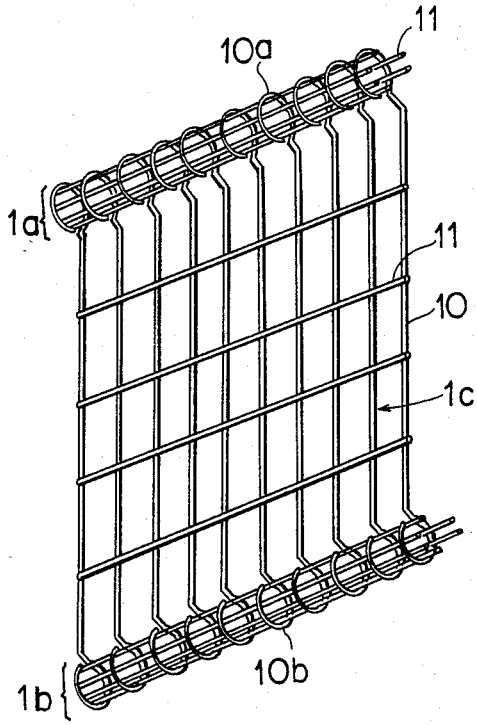
FIG. 17 is a perspective view of the latticework shown in FIG. 16.
Figure 18:
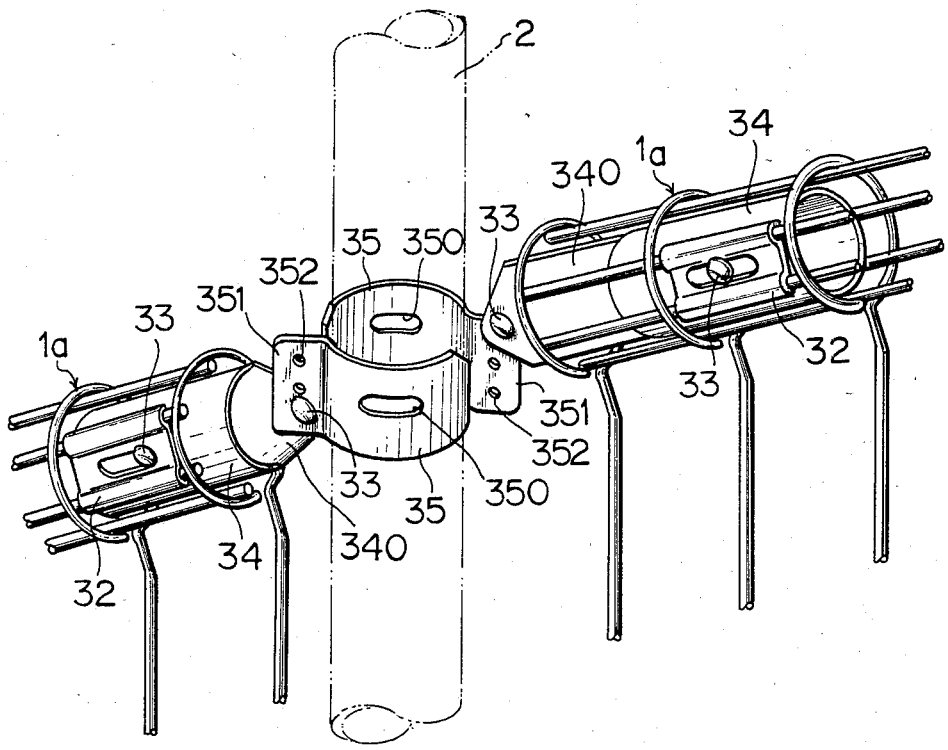
FIG. 18 is a perspective view showing the connecting means of the cylindrical part of the same.

FIGS. 16 and 18 show the fence for the slope ground. For the fence for the slope ground, a lattice body 1$\gamma$ and connector 3$\gamma$ are used therefor. Upper and lower circle portions 10*a*, 10*b* composing the cylindrical parts 1*a*, 1*b* of the vertical wire member 10, are bent toward length of the fence from its base along the oblique angle of the slope ground. That is, the bases of the circle portions 10*a*, 10*b* are bent so that the cylindrical portions 1*a*, 1*b* are almost in parallel with the inclining face. The horizontal wire member 11 is fixed to the vertical wire member 10 almost in parallel with the inclining face. Accordingly, the vertical wire member 10 crosses with the horizontal wire member 11 at right angle in the cylindrical parts 1*a*, 1*b*, and they cross at non-right angle.

Figure 19A:
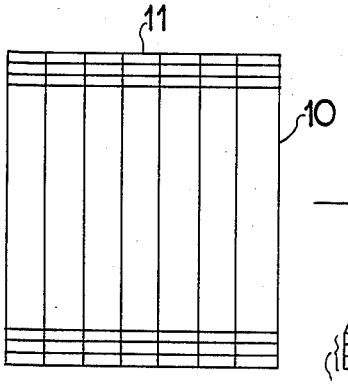
FIGS. 19A, 19B and 19C are explanatory views showing a making order of the lattice body.
Figure 19B:
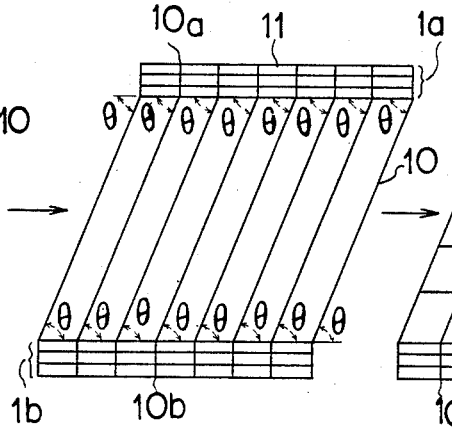
Figure 19C:
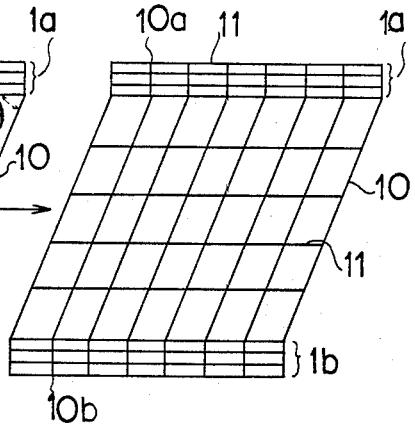

Making such a lattice body 1$\gamma$ can be understood from the following description. As shown in FIG. 19 (A), the horizontal wire members 11 are fixed only in a portion to be a cylindrical portion of the vertical wire member 10 at right angle, and the cylindrical parts 1*a*, 1*b* are in advance formed by bending the vertical member 10. Subsequently, the vertical wire member 10 is bent at the circle portion 10*a*, 10*b* by the oblique angle ($\theta$). This condition is shown in FIG. 19(B). Finally, the horizontal wire members 11 are secured in the plain part 1*c* in parallel with the horizontal wire members in the cylindrical part.

The lattice body 1$\delta$ is connected to the support 2 by means of the connector 3 (FIG. 16) for the inclining ground in the cylindrical parts 1*a*, 1*b*, and is connected to the support 2 by means of the connectors 4, 4' in the plain part 1*c*. The connectors 4, 4' have the same structure as shown in FIGS. 8 to 11. As shown in FIG. 18, the connector 3$\gamma$ comprises a tubular body 34, plate-like bands 35, a pressing metal plate 32 and a bolt-nut 33.

The tubular body 34 is a bit smaller in diameter than the cylindrical portions 1*a*, 1*b*. The tubular body 34 is formed with a bolt hole at its center, and is fixed with a triangular small piece 340 toward the support 2. The small piece 340 is formed with a bolt hole at its end. Each band follows the support 2 in the shape, and since the support 2 is the pipe the band is semi-circular. Each band 35 is formed with an oblong hole 350 at its center, and has a flat portion 351 which is formed with a plurality of the bolt holes 352. The pressing metal plate 32 and the bolt-nut 33 are the same as the connector 3 shown in FIG. 5. The band 35 and the small piece 340 are connected by inserting the bolt-nut in the bolt hole. Then the connecting angle is adjusted in accordance with the obliquity, and the bolt holes 352 in the flat portion 351 are in advance selected in view of the difference in height of the obliquity. The pressing metal plate 32 is engaged with the horizontal wire members 11 in the cylindrical part 1*a*, 1*b* to hold the cylindrical part at the both sides, and the bolt-nut 33 secures the pressing metal plates 32, 32, the horizontal wire members 11 of the cylindrical part and the tubular body 34.

The support 2 is kept by the bands 35, 35 of the connector 3$\gamma$ of the lattice bodies 1$\gamma$ at the both sides of the support, and the bolt is passed through the hole of the support 2 and the hole 350 of the bands 35. It is preferable that the bolt of the bolt-nut is round headed and square rooted. When the support 2 is endmost and holds the lattice body 1$\delta$ at the one side, the seat plate of the same shape as the band 35 is prepared and it is applied at the rear side.

I claim:

1. A fence of wire latticework, comprising a plurality of lattice bodies, a plurality of supports for supporting some of the lattice bodies laterally one from another and for supporting some of the lattice bodies in superimposed relation to each other; and connecting means for connecting said lattice bodies to the supports, and lattice bodies each being composed of a plurality of vertical wire members and a plurality of horizontal wire members, said vertical members in each lattice body being curved at their upper ends to form respective circular portions, and a group of horizontal members in each lattice body being arranged within the respective circular portions and connected thereto so as to form a respective upper cylindrical part of the respective lattice body.

2. The fence as defined in claim 1, further including coupling metal plates for securing the horizontal members in the upper cylindrical part of the lower one of said lattice bodies to the lower horizontal wire member of the respective lattice body superimposed with said lower one of said lattice bodies.

3. A fence of wire latticework, comprising at least one first lattice body and at least one second lattice body, said first lattice body being composed of a plurality of vertical wire members and a plurality of horizontal wire members, said vertical members being curved at their upper ends to form circular portions, a group of horizontal members being arranged within the circular portions and connected thereto so as to form an upper cylindrical part of the first lattice body, said second lattice body being composed of a plurality of vertical wire members and a plurality of horizontal wire members extending upwardly and in obliquity from said upper cylindrical part of the first lattice body; a plurality of supports for supporting said first lattice body and said second lattice body; and connecting means for connecting said first lattice body to the respective supports and said second lattice body to the respective supports.

4. The fence as defined in claim 3, further including connecting metal plates for securing the horizontal wire members within said upper cylindrical part of said first lattice body to the horizontal wire member of said second lattice body.

5. A fence of wire latticework, comprising at least one lattice body; supports for supporting said lattice body; and connecting means for connecting the lattice body to said supports, said lattice body having a plain part being composed of a plurality of vertical wire members and a plurality of horizontal wire members, said vertical wire members having upper ends and lower ends and being curved at least at their upper ends to form upper circular portions, a group of horizontal members being arranged within said upper circular portions and connected thereto so as to form an upper cylindrical part of the lattice body, the horizontal members of the plain part of the lattice body and of the cylindrical part thereof extending in accordance with obliquity of the ground on which the fence is to be positioned.

6. The fence as defined in claim 5, wherein the vertical wire members are curved at their lower ends to form a lower circular portion, a group of horizontal members being arranged within said lower circular portion and connected thereto so as to form a lower cylindrical part of the lattice body.

7. The fence as defined in claim 5, wherein the upper cylindrical part has a central axis, said central axis being positioned just above said plain part of the lattice body.

8. The fence as defined in claim 6, wherein the horizontal members in said upper cylindrical part and said lower cylindrical part are disposed in each part so that they are spaced from each other a smaller distance than that of the horizontal members in said plain part.

9. The fence as defined in claim 6, wherein the horizontal members in said upper cylindrical part and lower cylindrical part are larger in diameter than the horizontal members of said plain part.

10. The fence as defined in claim 6, wherein said connecting means comprise a first connector means for connecting the respective support to the respective cylindrical part of the lattice body, and a second connector means for connecting the respective support to the plain part of the lattice body.

11. The fence as defined in claim 10, wherein said first connector means include two tubular members disposed within the respective cylindrical parts of the lattice body and at both sides of the respective support; two plate-like bands embracing said respective support and connected to said two tubular members, respectively for supporting the respective support at an angle in accordance with obliquity of the ground on which the fence is to be positioned; first securing means for connecting said tubular members to said cylindrical parts; and second securing means for connecting said plate-like bands to said respective support.

12. The fence as defined in claim 10, wherein said first connector means include a tubular member disposed within the respective cylindrical part of the lattice body and at one side of the respective support, a plate-like band fixed to said cylindrical part and applied to one side of said support at an angle in accordance with the obliquity of the ground on which the fence is to be positioned, a seat metal plate attached to said support at the side thereof reversed to said plate-like band, first means for securing said tubular member to said respective cylindrical part; and second means for securing the plate-like band to said seat metal plate.

13. The fence as defined in claim 1, wherein the vertical members in a lowermost lattice body of said plurality of lattice bodies are curved at their lower ends to form lower cylindrical portions and wherein a group of horizontal members is provided within said lower circular portions to form a lower cylindrical part.

14. The fence as defined in claim 4, wherein the vertical members of said first lattice body are curved at their lower ends to form circular portions and a group of horizontal members are arranged within said circular portions and connected thereto so as to form a lower cylindrical part.

15. A fence of wire latticework, comprising at least one lattice body; supports for supporting the lattice body; and connecting means for connecting the lattice body to the supports, said lattice body including a plain part composed of a plurality of vertical wire members and a plurality of horizontal wire members, said vertical members being curved at their upper ends to form upper circular portions, and a group of horizontal members being arranged within said upper circular portions and connected thereto so as to form an upper cylindrical part of the lattice body, said vertical members being also curved at their lower ends to form lower circular portions, said lattice body further including an additional group of horizontal members arranged within said lower circular portions and connected thereto so as to form a lower cylindrical part of the lattice body, said upper cylindrical part having an upper central axis and said lower cylindrical part having a lower central axis, said upper central axis and said lower central axis both lying in a plane, containing said plain part of the lattice body.

16. The fence as defined in claim 15, wherein the horizontal members in said upper cylindrical part and said lower cylindrical part are disposed in each part so that they are spaced from each other a smaller distance than that of the horizontal members in said plain part.

17. The fence as defined in claim 15, wherein the horizontal members in said upper cylindrical part and lower cylindrical part are larger in diameter than the horizontal members of said plain part.

18. The fence as defined in claim 15, wherein each of said supports is provided with a cap, said cap being formed with convex projections on the side thereof facing an upper end of the respective support and being welded thereto.

19. The fence as defined in claim 15, wherein said connecting means comprise a first connector means for connecting the respective support to the respective cylindrical part of the lattice body, and a second connector means for connecting the respective support to the plain part of the lattice body.

20. The fence as defined in claim 19, wherein said first connector means include two tubular members disposed within the respective cylindrical parts of the lattice body and at both sides of the respective support; two plate-like bands embracing said respective support and connected to said two tubular members, respectively; first securing means for connecting said tubular members to said cylindrical parts; and second securing means for connecting said plate-like bands to said respective support.

21. The fence as defined in claim 19, wherein said first connector means include a tubular member disposed within the respective cylindrical part of the lattice body and at one side of the respective support, a plate-like band fixed to said cylindrical part and applied to one side of said support, a seat metal plate attached to said support at the side thereof reversed to said plate-like band, first means for securing said tubular member to said respective cylindrical part, and second means for securing the plate-like band to said seat metal plate.

22. The fence as defined in claim 19, wherein said first connector means include a first tubular body disposed with the respective cylindrical part of the lattice body at one side of the support, a second tubular member disposed within the respective cylindrical part of the lattice body positioned at a predetermined angle at another side of said support, a plate-like band connected to said first tubular member and said second tubular member and applied to said support, a seat metal plate applied to said support opposite to said plate-like band, first means for securing said tubular members to the respective cylindrical parts, and second means for securing the plate-like band to the seat metal plate.

23. The fence as defined in claim 19, wherein said second connector means comprise a pair of bands formed of wire elements having end portions and extending parallel to each other and applied to the respective support, and means for securing the respective end portions of said wire elements to an adjacent vertical member of the lattice body adjacent to said support.

24. The fence as defined in claim 19, wherein said second connector means include a pair of bands formed of wire elements having end portions and extending parallel to each other and applied to the respective support, a connecting piece for connecting the respective end portions of said wire elements to an adjacent vertical member of the lattice body adjacent to said support, and means for securing said connecting piece to said bands.

* * * * *